US007718873B1

(12) United States Patent
Slavik

(10) Patent No.: US 7,718,873 B1
(45) **Date of Patent: *May 18, 2010**

(54) STRINGED INSTRUMENT VIBRATO DEVICE

(76) Inventor: Randal L. Slavik, 3570 Douglass, Memphis, TN (US) 38111

( * ) Notice: Subject to any disclaimer, the term of this patent is extended or adjusted under 35 U.S.C. 154(b) by 0 days.

This patent is subject to a terminal disclaimer.

(21) Appl. No.: 12/352,708

(22) Filed: Jan. 13, 2009

Related U.S. Application Data

(63) Continuation-in-part of application No. 11/749,719, filed on May 16, 2007, now Pat. No. 7,479,592.

(51) Int. Cl.
*G10D 3/00* (2006.01)

(52) U.S. Cl. ..... 84/313; 84/312 R

(58) Field of Classification Search ..... 84/313, 84/312 R, 312 P
See application file for complete search history.

(56) References Cited

U.S. PATENT DOCUMENTS

| | | | | |
|---|---|---|---|---|
| 3,404,595 | A | 10/1968 | Harlin | |
| 4,712,463 | A | 12/1987 | Kubicki et al. | |
| 4,939,971 | A | 7/1990 | Satoh | |
| 5,083,492 | A | 1/1992 | Gorr | |
| 5,373,769 | A * | 12/1994 | Sherman | 84/313 |
| 5,672,835 | A | 9/1997 | Doughty | |
| 5,986,190 | A | 11/1999 | Wolff et al. | |
| 6,384,311 | B1 | 5/2002 | Cota | |
| 6,415,584 | B1 | 7/2002 | Whittall et al. | |
| 6,812,389 | B2 | 11/2004 | Trooien | |
| 6,919,501 | B2 | 7/2005 | Burton | |
| 7,235,730 | B2 * | 6/2007 | Hirayama | 84/307 |
| 2003/0183062 | A1 | 10/2003 | Schryer | |
| 2004/0051925 | A1 | 3/2004 | Smart | |
| 2004/0083875 | A1 | 5/2004 | Burton | |
| 2005/0076766 | A1 | 4/2005 | Didan | |
| 2006/0005687 | A1 | 1/2006 | Minakuchi | |
| 2006/0117930 | A1 | 6/2006 | Folmar et al. | |

* cited by examiner

*Primary Examiner*—Jianchun Qin
(74) *Attorney, Agent, or Firm*—QuickPatents, Inc.; Kevin Prince

(57) ABSTRACT

A vibrato device is disclosed for an instrument that has a plurality of strings. The vibrato device includes a base plate with a pivot means formed proximately to a forward side thereof. A plurality of string attachment means are each fixed to the base plate and independently pivotable, are each fixed to one string of the instrument, and include a string biasing means that keeps the string in tension, such that each string may be independently tuned without affecting the tuning of each other string. A vibrato handle is fixed to the base plate and, when moved, causes the base plate to pivot around the pivot means. As such, all strings on the instrument may be quickly and independently tuned, while still providing for an effective two-directional vibrato effect.

14 Claims, 14 Drawing Sheets

STRINGED INSTRUMENT VIBRATO DEVICE

CROSS-REFERENCE TO RELATED APPLICATIONS

This application is a continuation-in-part of U.S. Ser. No. 11/749,719, filed on May 16, 2007, now U.S. Pat. No. 7,479,592, which is hereby incorporated herein.

STATEMENT REGARDING FEDERALLY SPONSORED RESEARCH AND DEVELOPMENT

Not Applicable.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

FIELD OF THE INVENTION

This invention relates to musical instruments, and more particularly to a novel vibrato device for a stringed instrument.

DISCUSSION OF RELATED ART

Vibrato devices for guitars and other stringed instruments have been in use for many years for the special effect of bending the pitch of a note either higher or lower. Herein the term guitar typically refers to six-stringed guitars, but could mean any stringed instrument with any number of strings. The typical design used on guitars comprises a pivoting base plate located at the rear of the instrument, one or more string attachment devices mounted on top of the plate and an attached lever that, when moved, produces the is vibrato effect. Typically, two or three springs are attached at one end to the bottom of the plate to offset the tension of the strings, the strings being anchored to the instrument at their other ends.

Two basic types of vibratos exist: single directional, which can only change the pitch in one direction—usually higher, and two directional, which can either raise or lower the pitch at the musician's discretion.

The single directional vibrato is historically much older. It is fairly simple in design due to its limited abilities, relatively easy to tune and operate and is of no concern here.

The two directional device, often referred to as "full floating" vibrato, is more versatile to the musician and far more complex in design. Although these units are very popular, mostly among rock guitarists, every device on the market today has the same flaw—the inability to let the user tune the instrument quickly.

A non-vibrato, or solid-bridge guitar, such as the standard acoustic can be tuned by the average user in 1-2 minutes from a completely out of tune but "strings still attached" position. String replacement on a solid bridge guitar can easily be done by removing all six strings simultaneously, reattaching the six new strings and tuning them one at a time, usually in order from the lowest pitch string to the highest. Tuning each string only once results in the guitar being properly tuned when the series is finished. A single directional vibrato guitar may be tuned in substantially the same amount of time.

A full floating vibrato unit, however, will take the average user hours if not days to tune from a completely detuned condition, and many users find it beyond their ability entirely. The procedure involves far more than string pitch, becoming a delicate balancing act between the strings, the base plate, and springs located inside the body of the guitar. The procedure is so tedious that it is common to take the guitar to an experienced technician for a "set-up" requiring both time and money whenever new strings are required.

String replacement instructions included with the purchase of a new full floating guitar instruct the user to remove one string at a time, re-attach a new string, and re-tune the entire guitar before removing the next string. The process is then repeated five more times, once for each additional string. Even though this is far more tedious tuning than a solid bridge or single direction vibrato, the average user is capable of tuning his own guitar if that was the entire process.

However, the very nature of a full floating device forces the user to also level the "floating" base plate as well as tune the strings. Each time a string it tightened, the rear of the pivoting base plate rises. Each time the rear of the base plate rises, the tension of all other attached strings is lessened, dropping each in pitch. Tightening one string raises the rear of the base plate and in turn loosens all other strings. So in essence, raising the pitch of one string lowers the pitch of all other strings. Further, the tightening or loosening of the strings by use of the device stretches strings over time, loosening and detuning them. Common equipment on full floating guitars include tuning knobs and string locks at both ends of the guitar to help with the stretching problem, but the process is still too is cumbersome for many guitarists.

The public has found the problem so annoying that numerous devices are presently available on the market to try to help the average user tune a guitar without a technician's help. Several examples of such devices are taught in US Patent Applications and Patents 2004/0051925 to Smart on Mar. 18, 2004; 2004/0083875 to Burton on May 6, 2004; U.S. Pat. No. 6,812,389 to Trooien on Nov. 2, 2004; U.S. Pat. No. 6,919,501 to Burton on Jul. 19, 2005; and 2006/0005687 to Minakuchi on Jan. 12, 2006. Some of these devices lock the base plate from "floating" until the strings are tuned and the lock is removed, at which time the base plate moves anyway. Others lock the base plate permanently, deactivating the vibrato. While the guitar is then tunable, it behaves as nothing more than a solid bridge guitar, unsuitable for the serious enthusiast who wishes to have a vibrato effect as a playing option. Indeed, many guitarists have the device removed completely, opting for a solid bridge, to avoid the tuning problem altogether.

Further, if a string breaks while playing a full floating guitar, the guitarist is immediately thrown out of tune relative to other band members. Since the strings and springs are thrown out of balance with one less string pulling the plate upward, the springs take up the slack by pulling the plate downward, raising the pitch of the other five strings. Such an incident during a live performance can be disastrous if a replacement string and/or guitar is unavailable. US Patent Application 2005/0076766 to Didan on Apr. 14, 2005, attempts to address this problem.

U.S. Pat. No. 6,384,311 to Cota on May 7, 2002, shows a bass guitar with four separate vibrato units, one for each string. However, there is no way to vibrato all four strings together short of pushing on all four arms simultaneously.

US Patent Application 2003/0183062 to Schryer on Oct. 2, 2003, uses wheels that are notched like teeth on a sprocket, and each sprocketed wheel is locked inside a large cylindrical encasement. As such, there is no freedom of movement between strings once locked in place.

In my previous application, I successfully accomplished a vibrato device that allows for independent tuning of each string without substantially affecting the tuning of other strings. My prior device allows for quickly tuning all strings on the instrument, while still providing for an effective two-directional vibrato effect. Yet my prior device allows for greater changes upward in pitch than downward in pitch when the vibrato handle is actuated. As such, there is still a need for a vibrato device that allows for a generally equal number of steps in pitch both upward and downward when actuating the vibrato handle, while still retaining the benefits of my previous device. The present invention accomplishes these objectives.

SUMMARY OF THE INVENTION

The present device is a vibrato device for an instrument, such as a guitar, that has at least one string. The vibrato device includes a base plate with a pivot means formed proximately to a forward side thereof. A plurality of string attachment means are each fixed to the base plate and independently pivotable about an axis that is substantially parallel to, above, and to the rear of the forward side of the base plate. Each string attachment means is fixed to one string of the instrument and includes a string biasing means that keeps the string in tension. Each string biasing means generally balances the string around the pivot means. A vibrato handle is fixed to the base plate and, when moved, causes the base plate to pivot around the pivot means.

In use, with each string of the instrument fixed to one of the string attachment means, each string is tunable against the string biasing means independently of any other string. The base plate is biased thereby towards the pivot means along the longitudinal axis of the strings, whereby the vibrato handle may be moved to cause the base plate to pivot around the pivot means to cause the effective pitch of each string to be changed thereby. The base plate pivots on the pivot means while being prevented from lateral or elevational movement thereon.

In a simple embodiment of the invention, each string attachment means is an elongated string block having a forward end and an aperture therein for receiving one of the strings. The string block further includes proximate a rear end thereof a pivot aperture therein for pivoting around a pivot pin that is fixed with the base plate. The longitudinal axis of the pivot aperture is substantially perpendicular to the longitudinal axis of the string aperture. The axis of the pivot pin may be elevated above, or below, the base plate by fixing the is pivot pin to the base plate through a pair of raised, or lowered, pivot pin tabs.

A bridge is selectively fixable with the base plate. Each string attachment means holds one of the strings of the instrument against the bridge, which may include at least one roller for contacting each string. In one embodiment of the invention, each elongated string block further includes a second roller for contacting one of the strings. Further, the bridge may include a plurality of independent bridge elements, each of which is independently fixable to the base plate, and each being offset from adjacent bridge elements if desired. In one embodiment of the invention, each elongated string block is formed integrally with one bridge element, wherein each string block includes its own pivot pin.

The present invention is a vibrato device that allows for independent tuning of each string without substantially affecting the tuning of other strings. The present device allows for quickly tuning all strings on the instrument, while still providing for an effective two-directional vibrato effect, allowing for a generally equal number of steps in pitch both upward and downward when actuating the vibrato handle in either direction. Further, the present invention is easily added to existing guitars and other stringed instruments. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
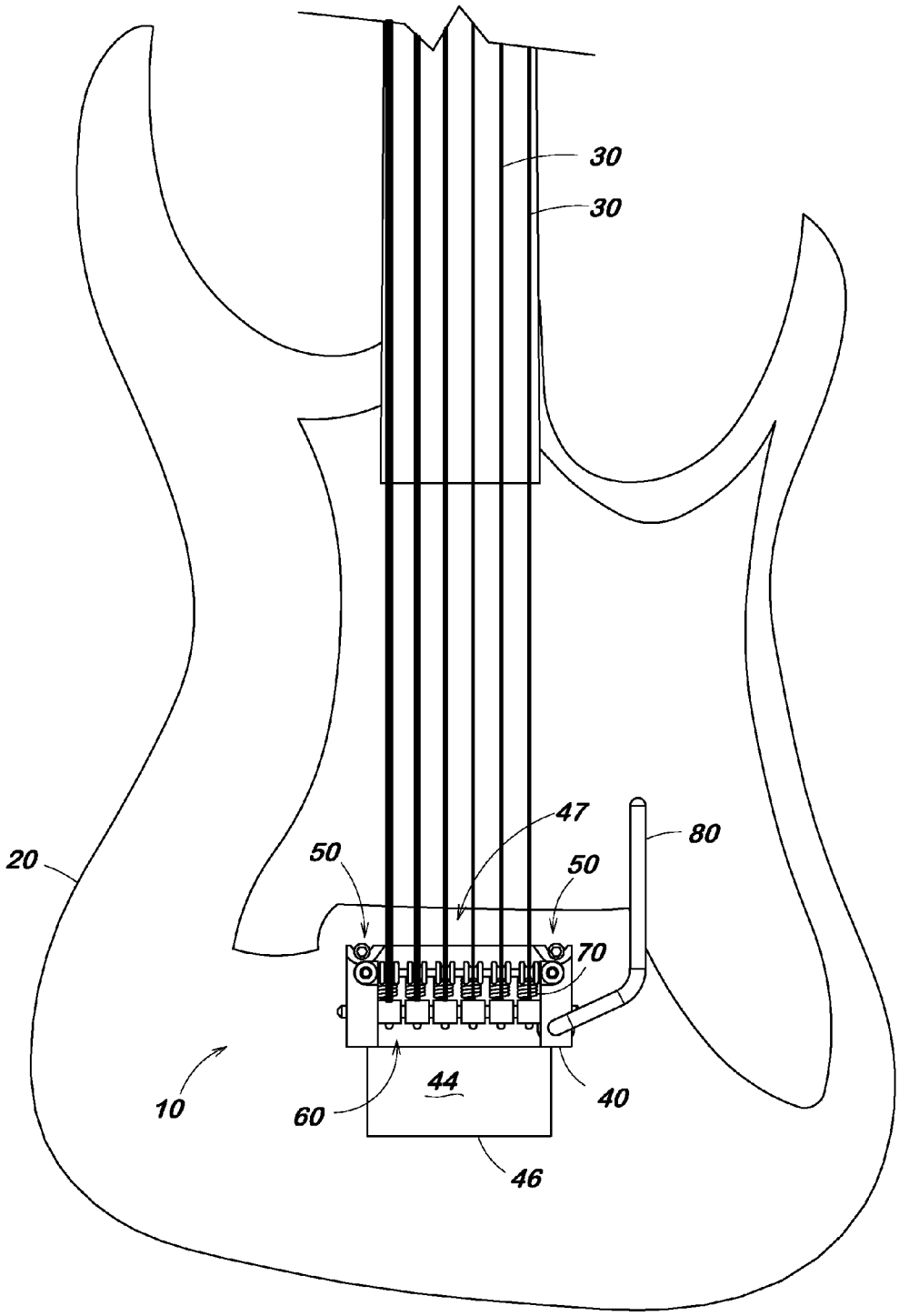
FIG. 1 PRIOR ART
FIG. 1 is a partial top plan view of my prior art invention as installed in a guitar.
Figure 2:
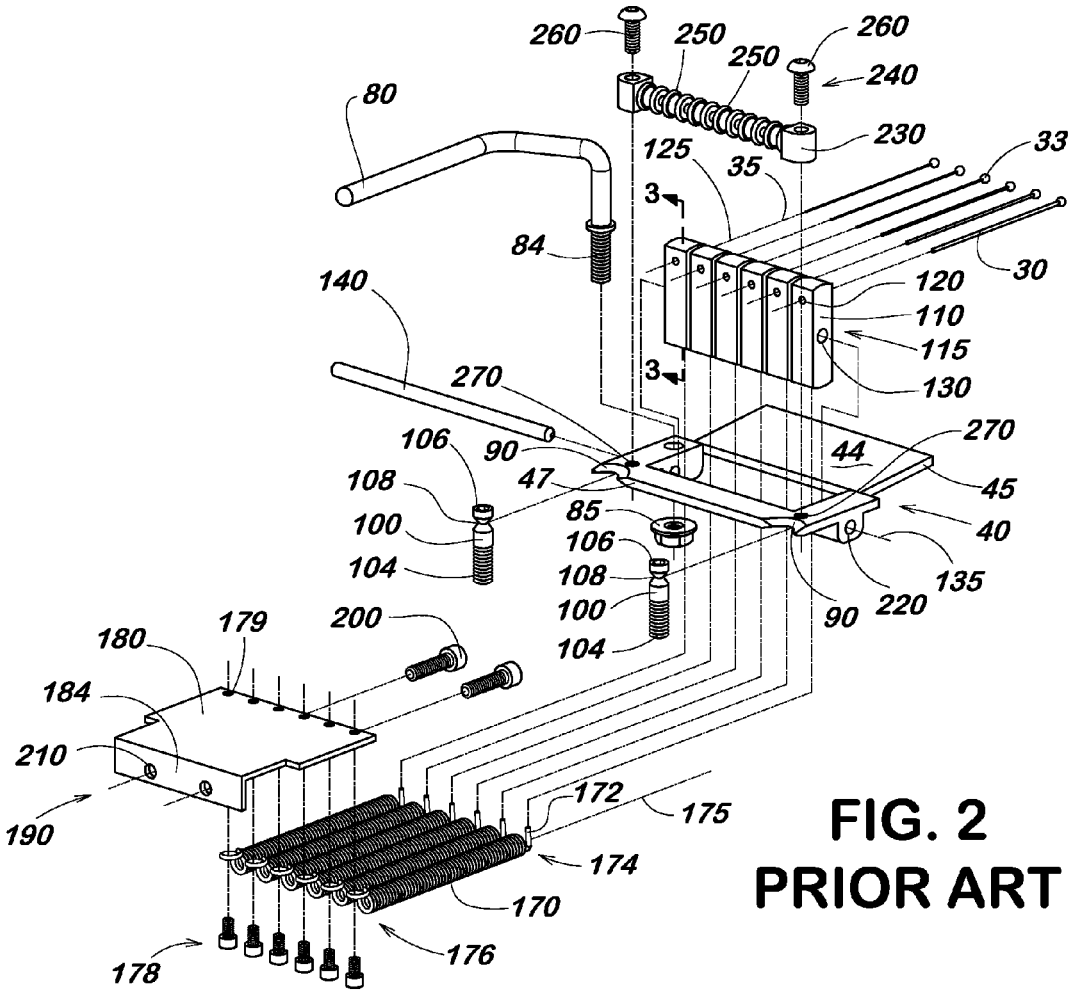
FIG. 2 PRIOR ART
FIG. 2 is an exploded view of my prior art invention.
Figure 3:
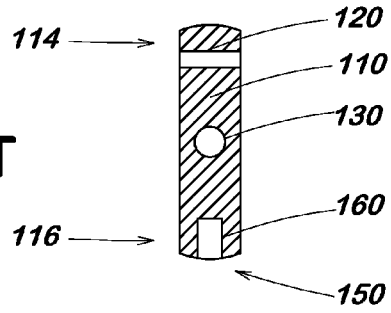
FIG. 3 PRIOR ART
FIG. 3 is a cross-sectional view of a string attachment means of my prior art invention, taken generally along lines 3-3 of FIG. 2.
Figure 4:
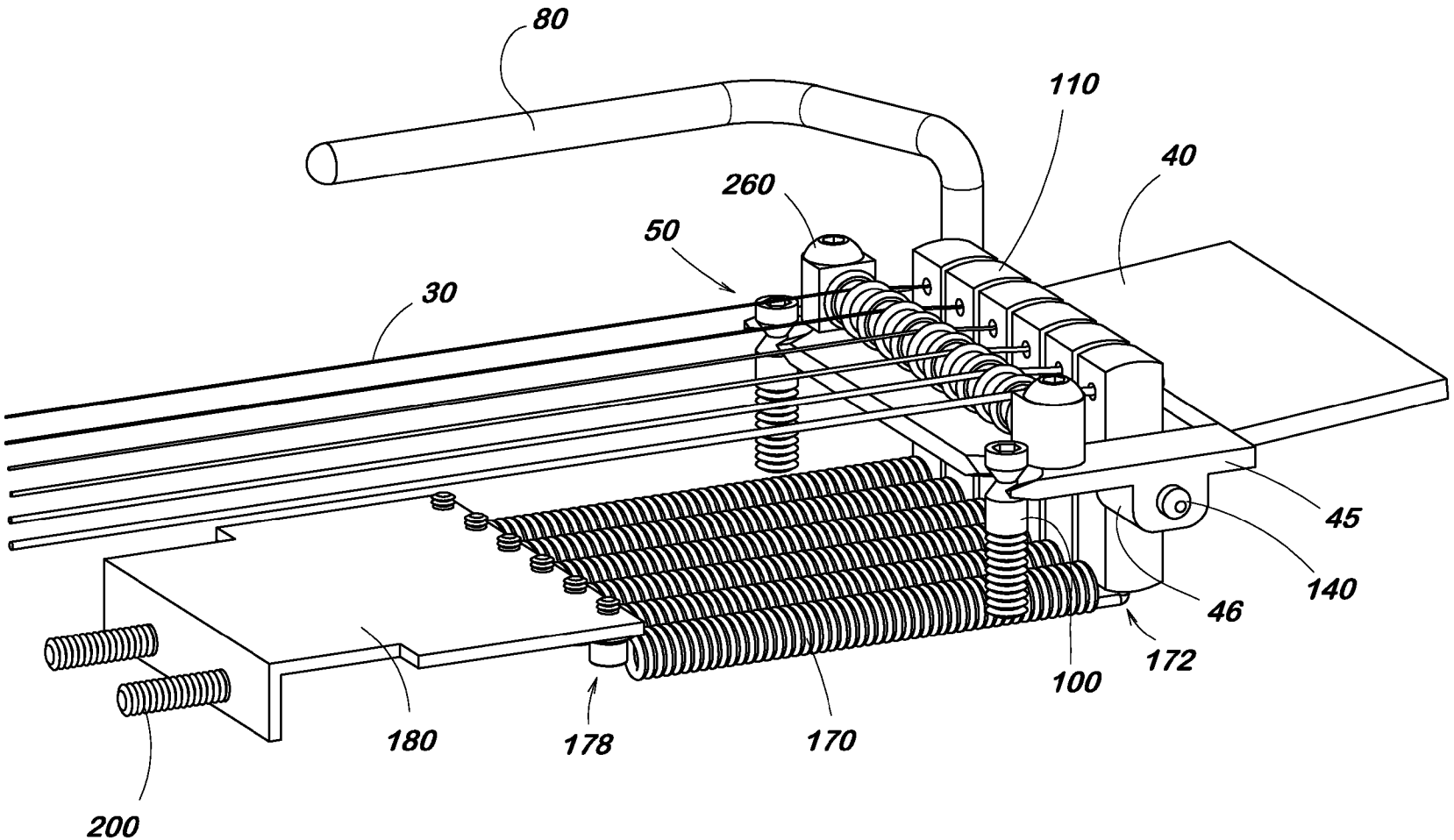
FIG. 4 PRIOR ART
FIG. 4 is a partial perspective view of my prior art invention.
Figure 5:
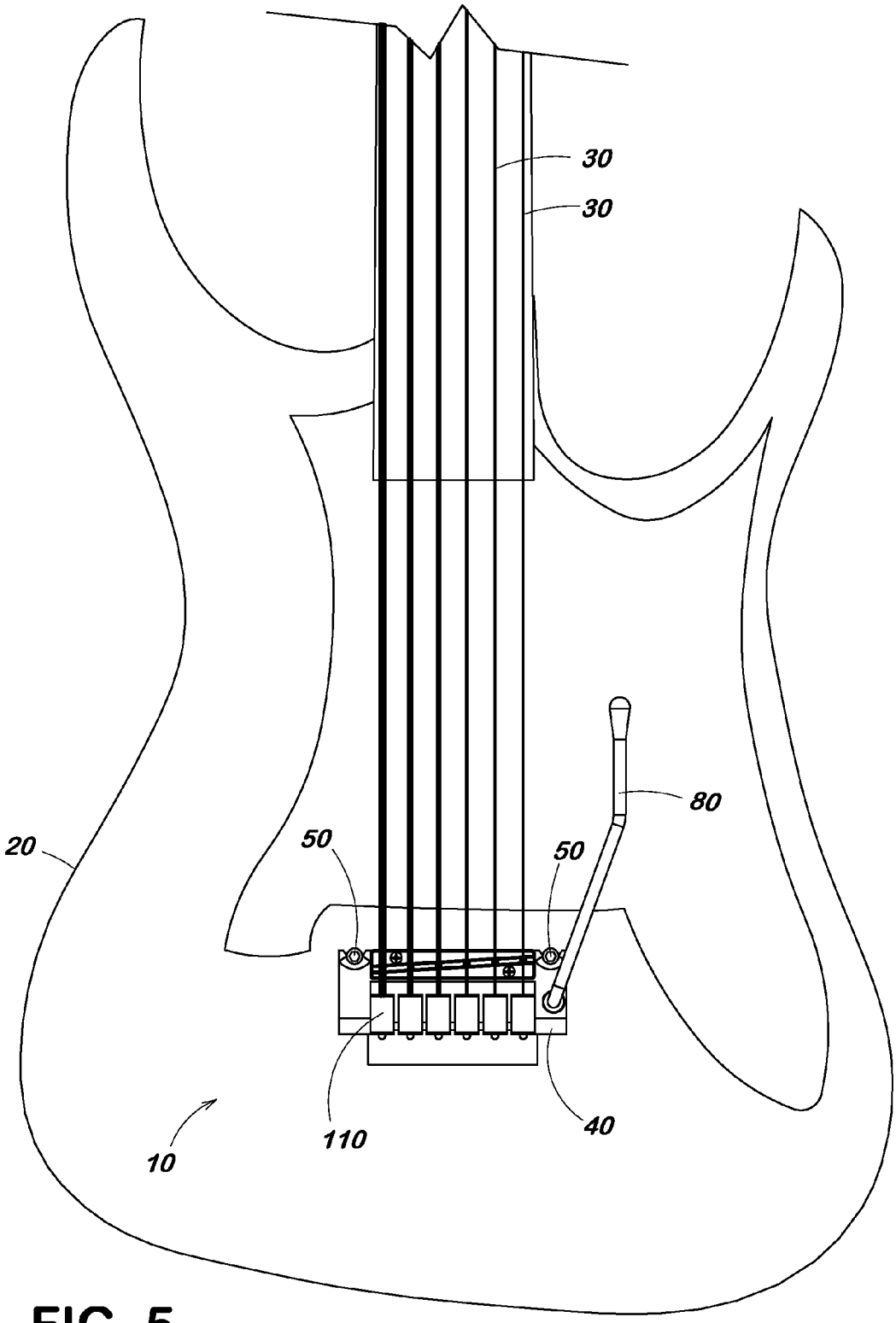
FIG. 5 is a partial top plan view of one embodiment of the invention.
Figure 6:
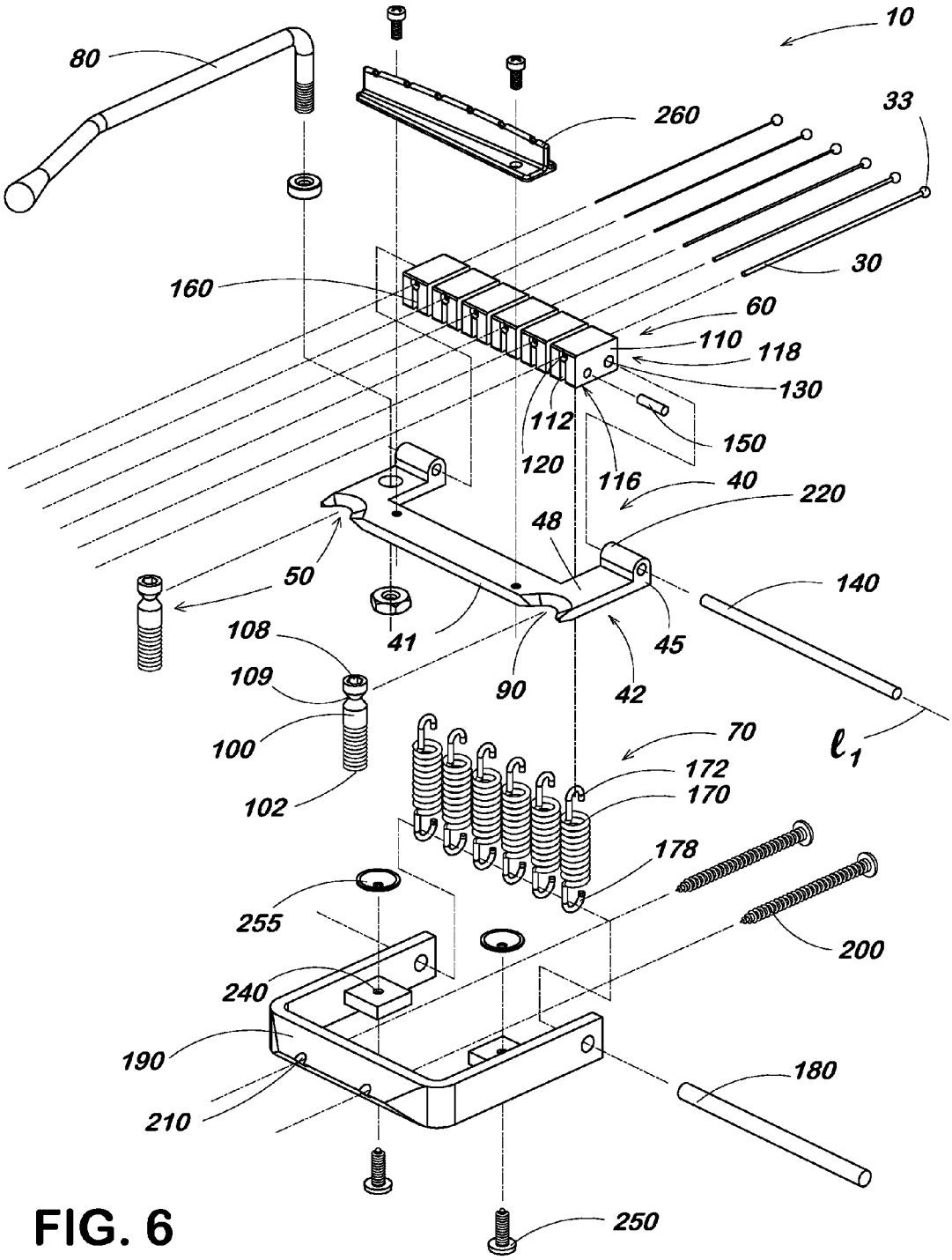
FIG. 6 is an exploded view of the embodiment of FIG. 5.
Figure 7:
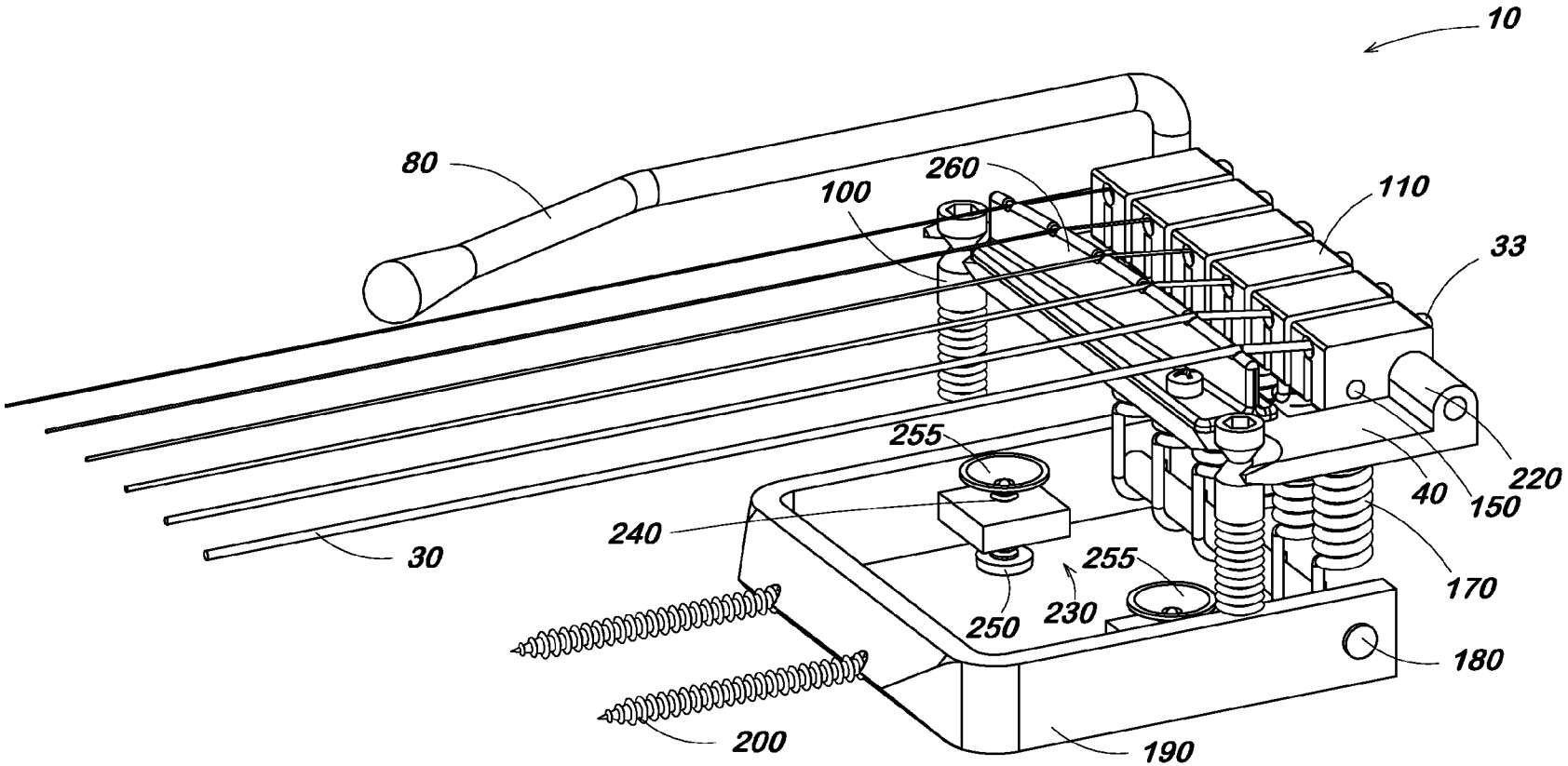
FIG. 7 is a partial perspective view of the embodiment of FIG. 5.
Figure 8:
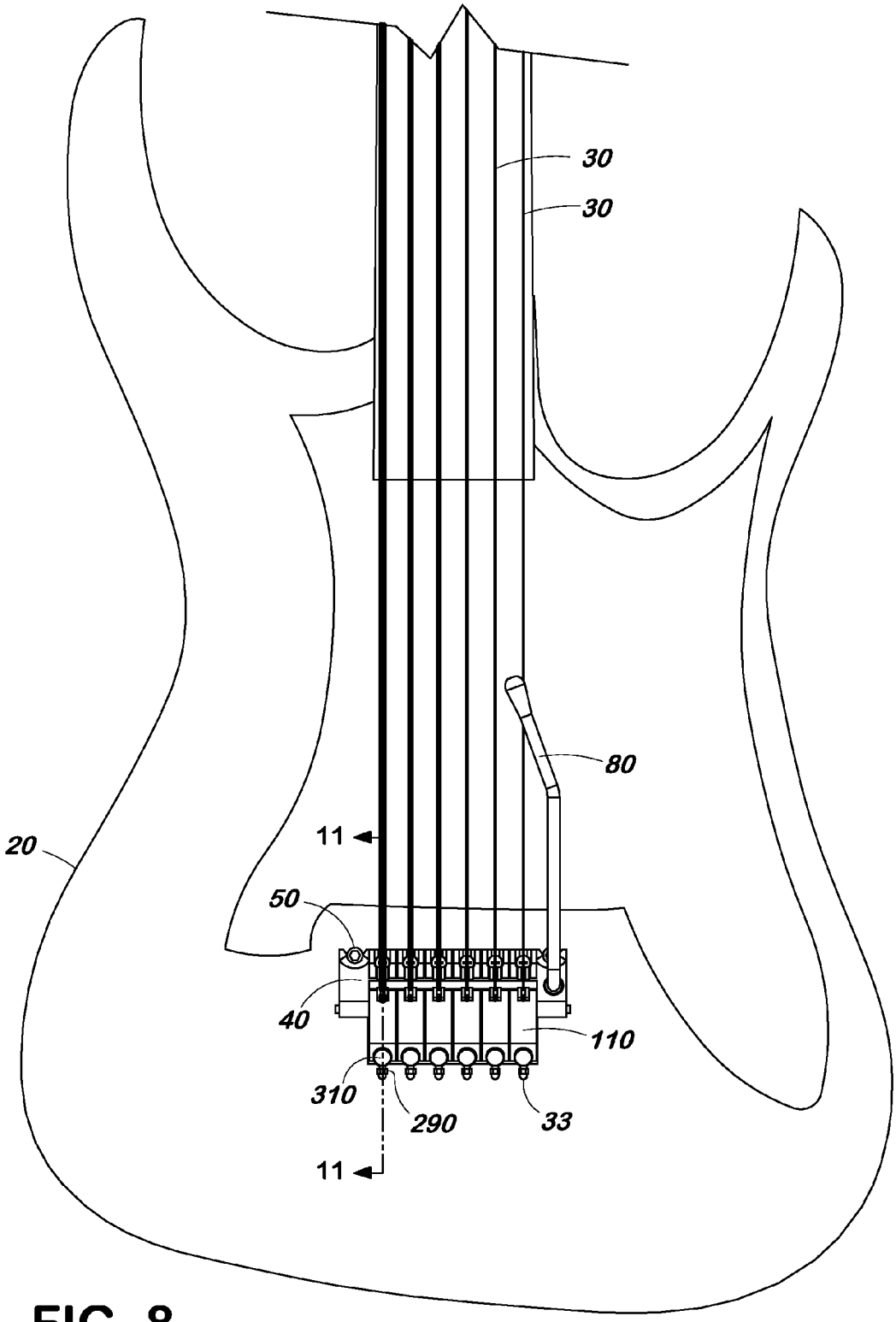
FIG. 8 is a partial top plan view of another embodiment of the invention.

FIGS. 5-7 illustrate a simple embodiment of a vibrato device 10 for an instrument 20 that has a plurality of strings 30. Each string preferably includes a string stop 33 at an end thereof. The vibrato device 10 includes a base plate 40 that has a top surface 48, a bottom surface 42, and at least one peripheral edge 45 connecting the top surface 48 with the bottom surface 42. A pivot means 50 is formed proximately to a forward side 41 of the at least one peripheral edge 45. Preferably the pivot means 50 includes two tapered notches 90 in the forward side 41 of the peripheral edge 45 and two pivot bolts 100. Each pivot bolt 100 is fixed at one end 102 to the instrument 20 and has at a second end 108 a tapered waist 109 for engaging one of the tapered notches 90 (FIGS. 6 and 7).

A plurality of string attachment means 60 are each fixed to the base plate 40 and independently pivotable about an axis $l_1$ that is substantially parallel to and to the rear of, the forward side 41 of the peripheral edge 45. Each string attachment means 60 is fixed to one string 30 of the instrument 20 and includes a string biasing means 70 that keeps the string 30 in tension at the string attachment means 60. Each string biasing means 70 generally balances the string 30 around the pivot means 50. A vibrato handle 80 is fixed to the base plate 40 and, when moved, causes the base plate 40 to pivot around the pivot means 50.

In use, with each string 30 of the instrument 20 fixed to one of the string attachment means 60, each string is tunable against the string biasing means 70 independently of any other string 30. The base plate 40 is biased thereby towards the pivot means 50 along the longitudinal axis of the strings 30, whereby the vibrato handle 80 may be moved to cause the base plate 40 to pivot around the pivot means 50 to cause the effective pitch of each string 30 to be changed thereby. The base plate 40 pivots on the pivot bolts 100 at the notches 90 therein while being prevented from lateral or elevational movement thereon.

In the simple embodiment of the invention, each string attachment means 60 is an elongated string block 110 having a forward end 112 and an aperture 120 therein for receiving one of the strings 30 of the instrument 20. The longitudinal axis of the aperture 120 is generally co-aligned with the longitudinal axis of the string 30. The string block 110 further includes proximate a rear end 118 thereof a pivot aperture 130 therein for pivoting around a pivot pin 140 that is fixed with the base plate 40. The longitudinal axis of the pivot aperture is substantially perpendicular to the longitudinal axis of the string aperture 120. The axis $l_1$ may be offset above (FIG. 6) or below (not shown) the base plate 40 by fixing the pivot pin 140 to the base plate 40 through a pair of pivot pin tabs 220 of the base plate 40.

The string block 110 further includes a spring attachment means 150 fixed at a bottom side thereof. In one embodiment each spring attachment means 150 is a spring attachment aperture 160 traversing the bottom side 116 of each string block 110 and is adapted to capture one of the string biasing means 70 therein. Each string biasing means 70 may be, for example, a coil spring 170 having one end 172 fixed to one of the spring attachment means 150 and a second end 178 fixed to a spring attachment rod 180 that is fixed with the instrument 20 with a spring attachment rod mounting means 190 (FIG. 6), such as a generally U-shaped bracket that includes at least one instrument mounting bolt 200 that is attachable to the instrument 20 through a bolt aperture 210 formed in a forward end of the bracket.

A global tension adjustment means 230 may include a pair of threaded apertures 240 fixed to the spring attachment rod mounting means 190, each having a threaded adjustment screw 250 rotationally engaged therewith and each having a screw foot 255 is fixed thereto. As such, the screw foot 255 of each threaded adjustment screw 250 presses against the instrument 20 when mounted therein to cause the spring attachment rod mounting means 190 to pivot about each instrument mounting bolt 200 for adjusting the tension in each of the coil springs 170 (FIG. 7).

Figure 9:
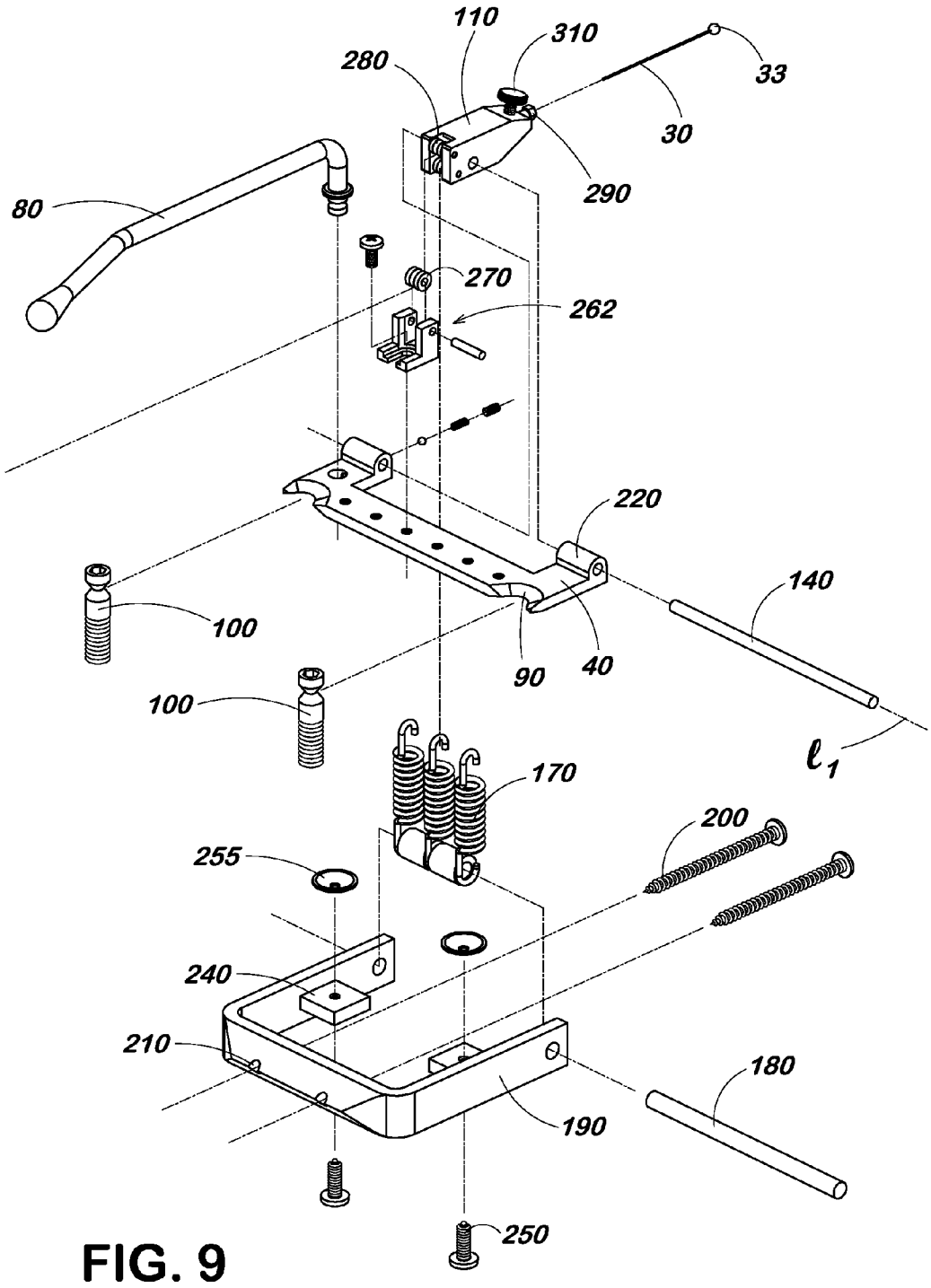
FIG. 9 is an exploded view of the embodiment of FIG. 8.
Figure 10:
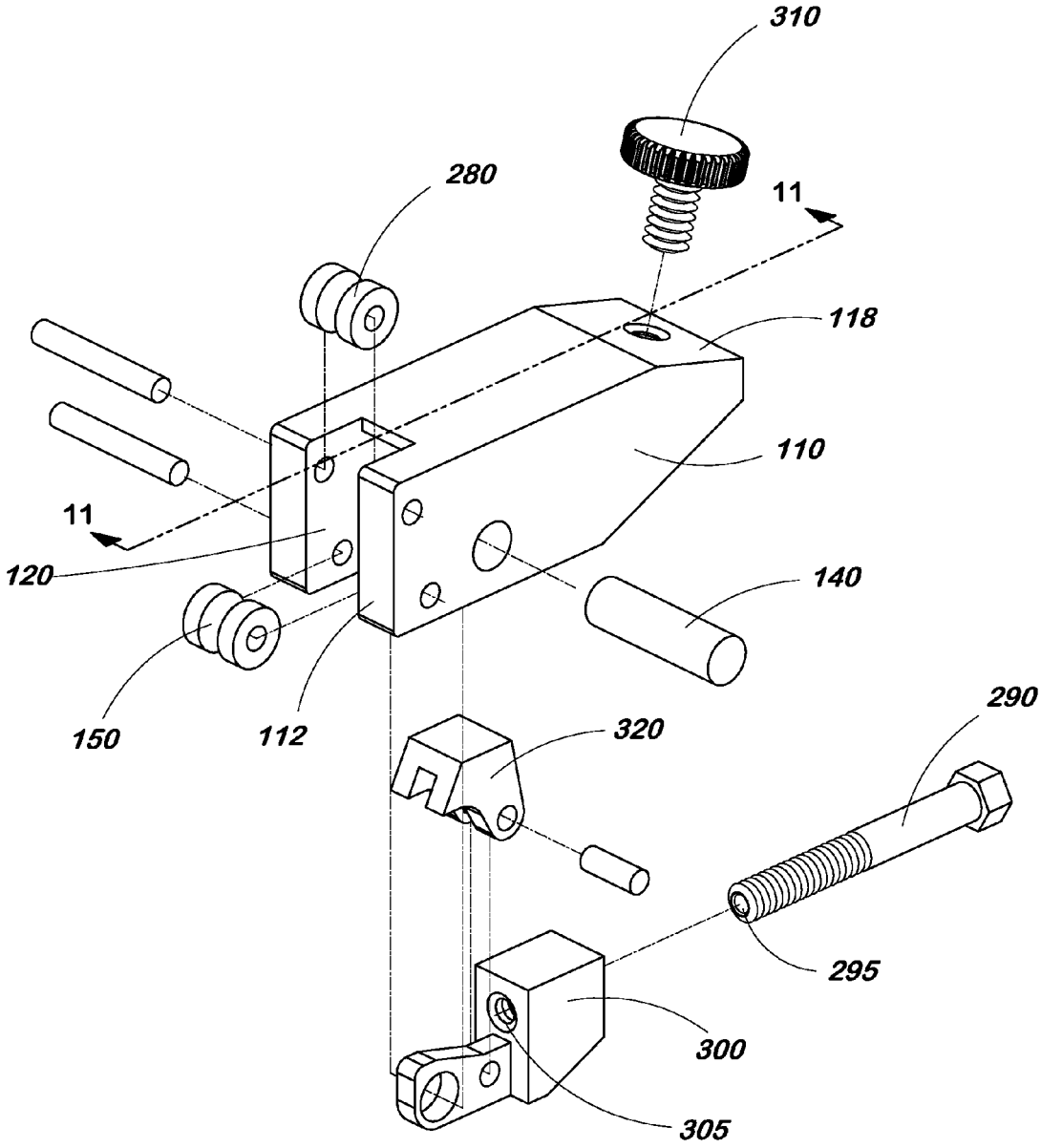
FIG. 10 is an exploded perspective view of an elongated string block of the embodiment of FIG. 8.
Figure 11A:
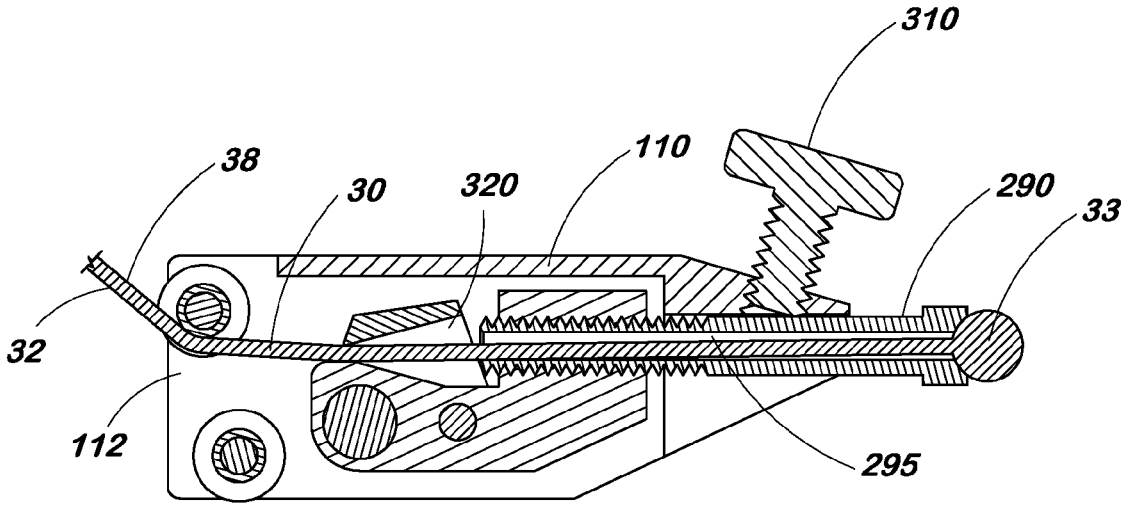
FIG. 11A is a cross-sectional view of the elongated string block of the embodiment of FIG. 8, taken generally along lines 11-11 of FIG. 8, and illustrating a fine-tuning screw in a raised position.
Figure 11B:
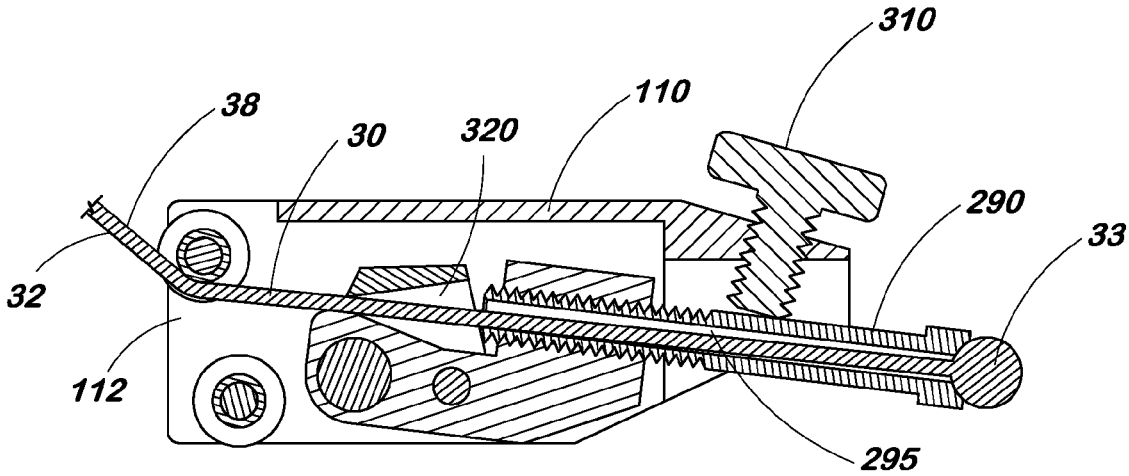
FIG. 11B is a cross-sectional view of the elongated string block of the embodiment of FIG. 8, taken generally along lines 11-11 of FIG. 8, and illustrating the fine-tuning screw in a lowered position.
Figure 12:
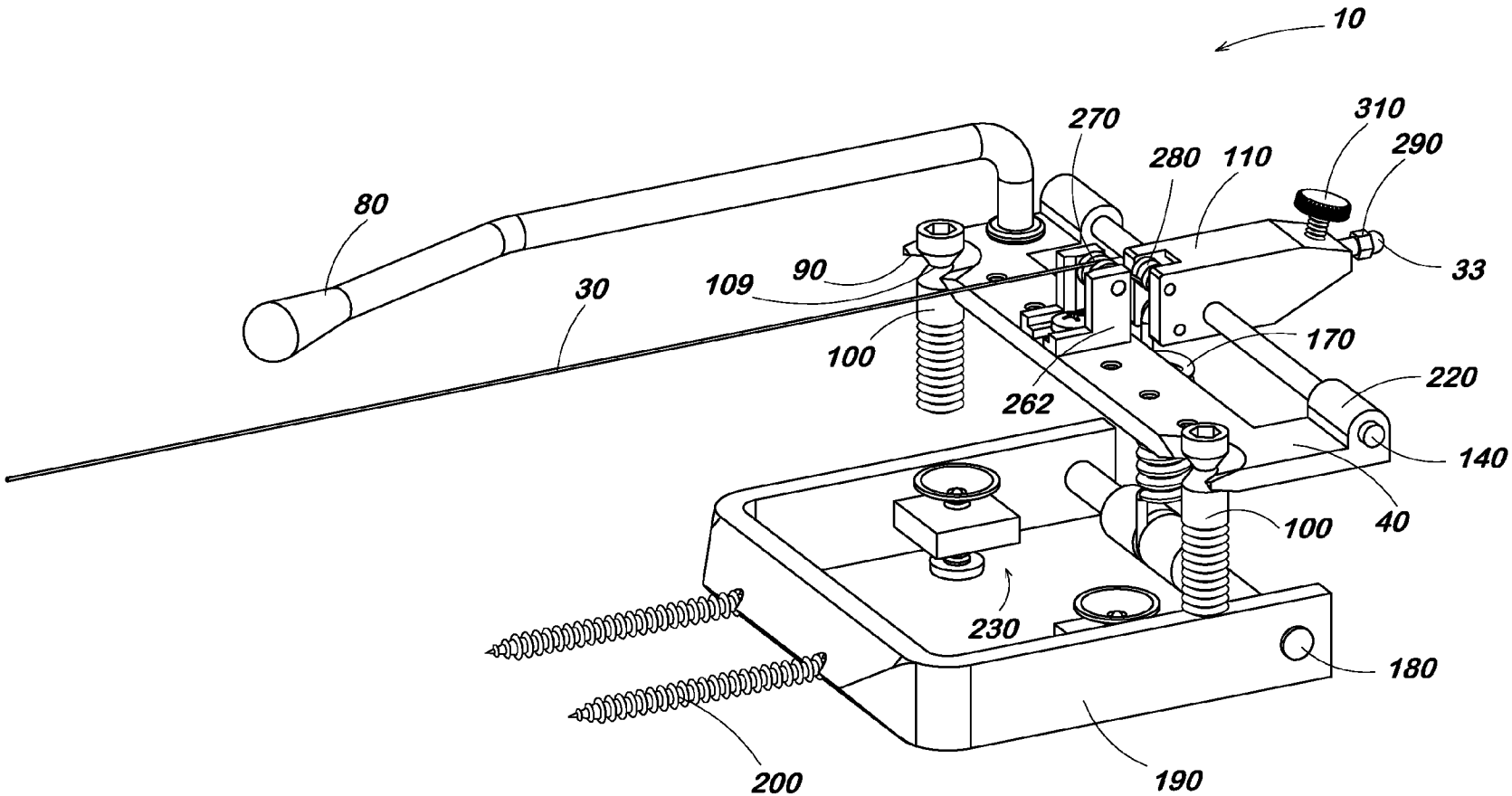
FIG. 12 is a partial perspective view of the embodiment of FIG. 8.

A bridge 260 is selectively fixable with the top surface 48 of the base plate 40. Each string attachment means 60 holds one of the strings 30 of the instrument 20 against the bridge 260. The bridge 260 may include at least one roller 270 for contacting each string 30 of the instrument 20, preferably at a bottom side 32 thereof. In one embodiment of the invention, each elongated string block 110 further includes a second roller 280 pivotally fixed between the aperture 120 of the forward end 112 thereof, and each second roller 280 contacts one of the strings 30 of the instrument 20 on a top side 38 thereof (FIGS. 8-12). Further, the bridge 260 may include a plurality of bridge elements 262, each of which is independently fixable to the base plate 40, and each being offset from adjacent bridge elements 262 if desired (FIG. 9).

FIGS. 9-12 illustrate an embodiment wherein each elongated string block 110 further includes a threaded string locking bolt 290 for receiving along a hollow longitudinal bore 295 therein one of the strings 30 of the instrument 20. The string locking bolt 290 is engaged with a threaded aperture 305 in a pivot block 300 that pivots around the pivot pin 140 and is pivotally fixed within the string block 110. A threaded fine-tuning screw 310 traversely mounted in the string block 110 is adapted to press against the locking bolt 290 and pivot the pivot block 300 to change the tension on the string 30.

Each pivot block 300 may further include a string lock 320 pivotally fastened thereto. In such an embodiment the string locking bolt 290 is adjustable to press the string lock 320 against the string 30 to lock the string 30 longitudinally in place with respect to the pivot block 300.

Figure 13:
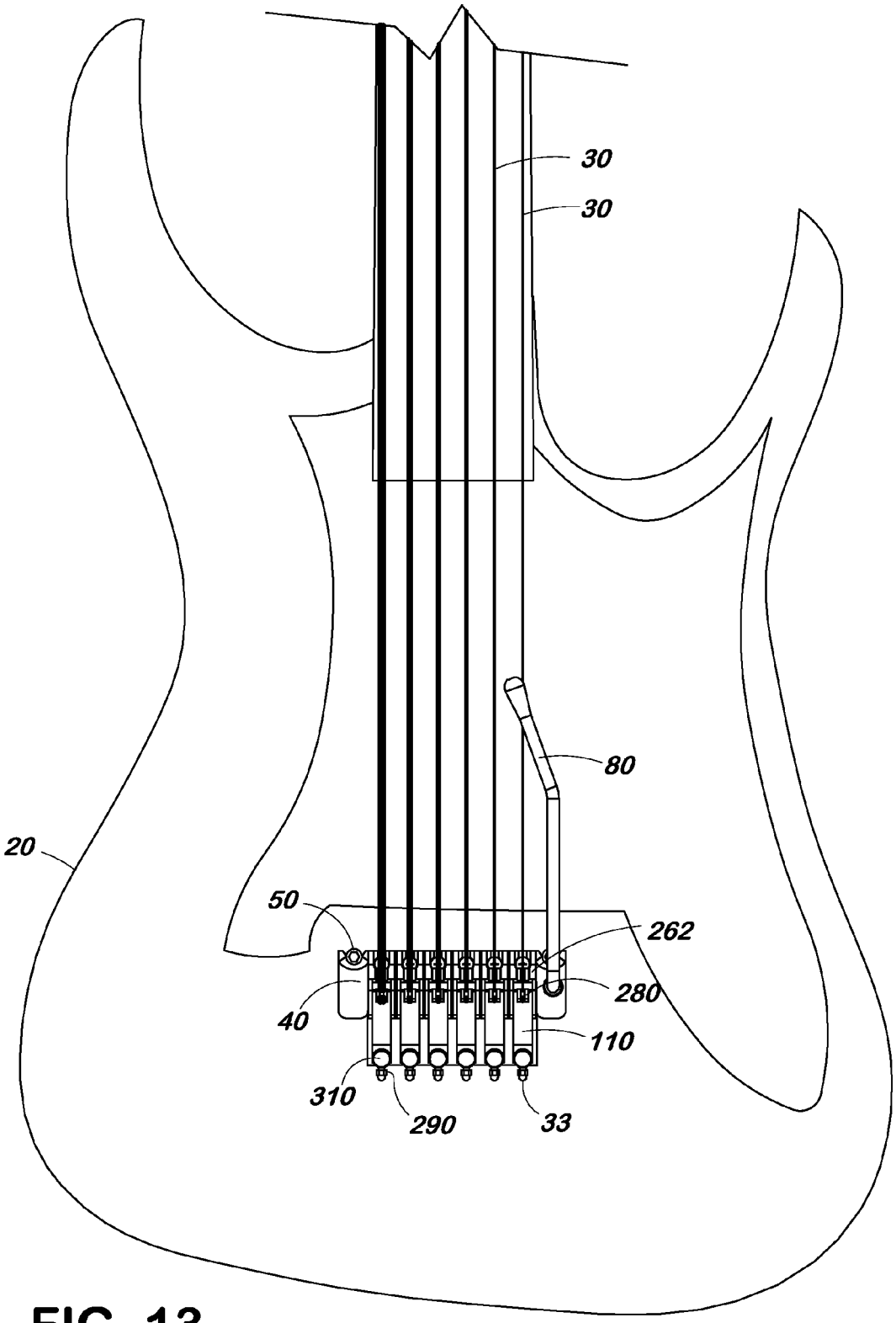
FIG. 13 is a partial top plan view of yet another embodiment of the invention.
Figure 14:
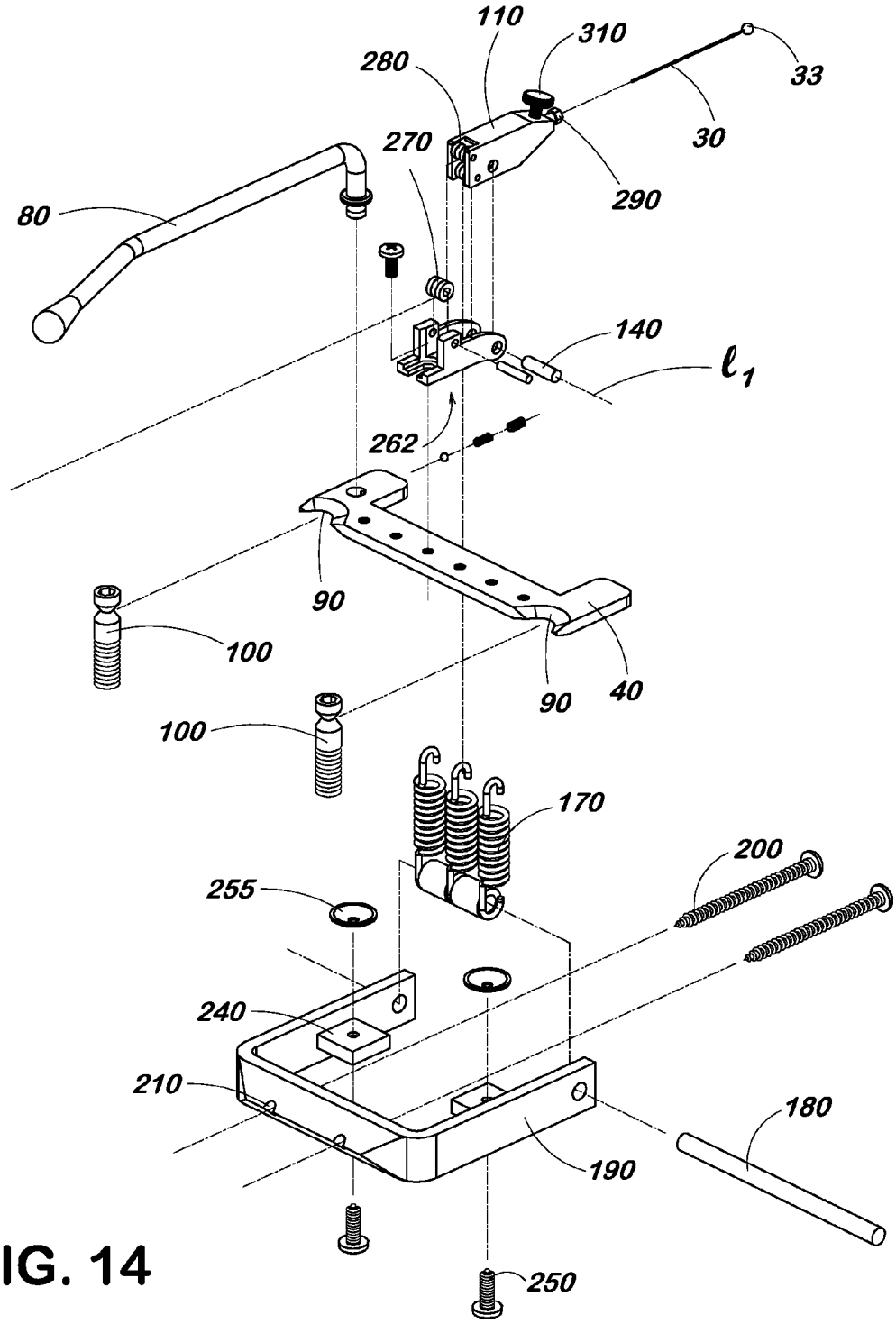
FIG. 14 is an exploded view of the embodiment of FIG. 13.
Figure 15:
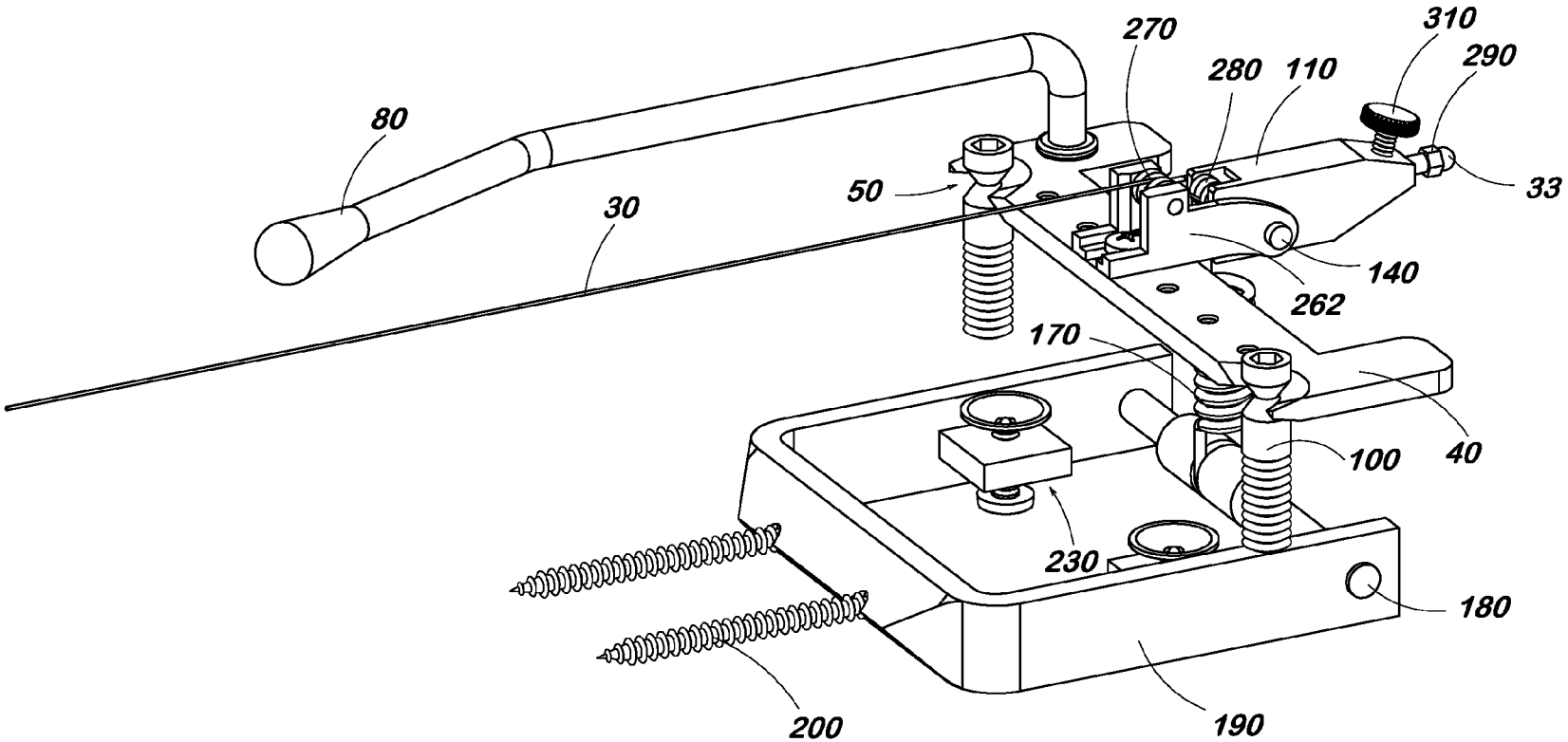
FIG. 15 is a partial perspective view of the embodiment of FIG. 13.

In one embodiment, illustrated in FIGS. 13-15, each elongated string block 110 is formed integrally with one bridge element 262, wherein each string block 110 includes its own pivot pin 140. As such, only as many elongated string blocks 110 need to be included as there are strings 30 on the instrument 20, and such string blocks 110 may be easily individually replaced if damaged, for example.

While a particular form of the invention has been illustrated and described, it will be apparent that various modifications can be made without departing from the spirit and scope of the invention. For example, the particular shape of each elongated string block and the base plate may be varied from those illustrated. Further, while each string block 110 of the present invention has been illustrated on a mechanical pivot pin 140, an alternate form of the invention instead includes a resilient rubber block (not shown) fixed between each string block 110 and the base plate 40. As such, a resilient rubber block acts as the string biasing means 70. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A vibrato device for an instrument having a plurality of strings, the vibrato device comprising:

a base plate having a top surface, a bottom surface, and at least one peripheral edge connecting the top and bottom surfaces, the at least one peripheral edge comprising a forward side having a pivot means fixed proximately thereto;

a plurality of string attachment means each fixed to the base plate and independently pivotable about an axis substantially parallel to and to the rear of the forward side of the peripheral edge, each string attachment means fixed to one string of the instrument and each string attachment means including one of a plurality of independently operable string biasing means that keeps the string in tension at the string attachment means, the string biasing means generally balancing the string tension around the pivot means;

a vibrato handle fixed to the base plate, the handle when moved causing the base plate to pivot around the pivot means;

whereby with each string of the instrument being fixed to one of the string attachment means, each string tunable against the string biasing means independently of any other string, the base plate being biased thereby towards the pivot means along the longitudinal axis of the strings, and whereby the vibrato handle when moved, causes the base plate to pivot around the pivot means to cause the effective pitch of each string to be changed thereby.

2. The vibrato device of claim 1 wherein the pivot means includes two tapered notches in the forward side of the peripheral edge and two pivot bolts, each bolt fixed at one end to the instrument and having at a second end a tapered waist for engaging one of the tapered notches, whereby with tension from each string and string biasing means biasing the base plate towards the pivot bolts, the base plate pivots on the bolts at the notches therein while being prevented from lateral or elevational movement thereon.

3. The vibrato device of claim 1 wherein each string attachment means is an elongated string block having at a forward end an aperture therein for receiving one of the strings of the instrument, the longitudinal axis of the aperture generally co-aligned with the longitudinal axis of the string, the string block further including proximate a rear end a pivot aperture therein for pivoting around a pivot pin fixed with the base plate, the longitudinal axis of the pivot aperture being substantially perpendicular to the longitudinal axis of the string aperture, the string block further including a spring attachment means fixed at a bottom side thereof for attaching to the string biasing means.

4. The vibrato device of claim 3 wherein each spring attachment means is a spring attachment aperture traversing the bottom side of one of the string blocks and is adapted to capture one of the string biasing means therein.

5. The vibrato device of claim 3 wherein the pivot pin is fixed to the base plate through a pair of pivot pin tabs of the base plate.

6. The vibrato device of claim 3 wherein each elongated string block further includes a threaded string locking bolt for receiving along a hollow longitudinal bore therein one of the strings of the instrument, the string locking bolt engaged with a threaded aperture in a pivot block, a fine-tuning screw traversely mounted in the string block for pressing against the locking bolt and pivoting the pivot block to change the tension on the string.

7. The vibrato device of claim 6 wherein each pivot block further includes a string lock pivotally fastened thereto, the string locking bolt adjustable to press the string lock against the string to lock the string longitudinally in place with respect to the pivot block.

8. The vibrato device of claim 1 wherein each string biasing means is a coil spring having one end fixed to one of the spring attachment means.

9. The vibrato device of claim 8 wherein each coil spring includes a second end fixed to a spring attachment rod, the spring attachment rod being fixed to the instrument with a spring attachment rod mounting means.

10. The vibrato device of claim 9 wherein the spring attachment rod mounting means includes at least one instrument mounting bolt, each attachable to the instrument through a bolt aperture formed in a forward end of the spring attachment rod mounting means.

11. The vibrato device of claim 10 further including a global tension adjustment means comprising a pair of threaded apertures fixed to the spring attachment rod mounting means, each having a threaded adjustment screw rotationally engaged therewith and each threaded adjustment screw having a screw foot fixed thereto, whereby the screw foot of each threaded adjustment screw presses against the instrument when mounted therein to cause the spring attachment rod mounting means to pivot around each instrument mounting bolt for adjusting the tension in each of the coil springs.

12. The vibrato device of claim 10 further including a bridge selectively fixable to the top surface of the base plate, the spring attachment means each holding one of the strings of the instrument against the bridge.

13. The vibrato device of claim 10 wherein the bridge includes at least one roller for contacting each string of the instrument.

14. The vibrato device of claim 13 wherein each roller of the bridge contacts one of the strings of the instrument on a bottom side thereof, and wherein each elongated string block further includes a second roller pivotally fixed between the aperture of the forward end thereof, each second roller contacting one of the strings of the instrument on a top side thereof.

* * * * *